US008181494B2

(12) United States Patent
Crider

(10) Patent No.: US 8,181,494 B2
(45) Date of Patent: May 22, 2012

(54) GARMENT STAIN TREATMENT BAG

(76) Inventor: Cynthia Crider, Celebration, FL (US)

( * ) Notice: Subject to any disclaimer, the term of this patent is extended or adjusted under 35 U.S.C. 154(b) by 1055 days.

(21) Appl. No.: 12/114,230

(22) Filed: May 2, 2008

(65) Prior Publication Data

US 2008/0274926 A1 Nov. 6, 2008

Related U.S. Application Data

(60) Provisional application No. 60/916,089, filed on May 4, 2007.

(51) Int. Cl.
*D06F 1/04* (2006.01)

(52) U.S. Cl. ..... 68/213; 68/200

(58) Field of Classification Search ..... 68/213, 68/200

See application file for complete search history.

(56) References Cited

U.S. PATENT DOCUMENTS

| | | | | |
|---|---|---|---|---|
| 2,342,406 | A * | 2/1944 | Latta et al. | 383/89 |
| 3,645,669 | A * | 2/1972 | Rausch | 8/137 |
| 4,659,496 | A * | 4/1987 | Klemm et al. | 510/297 |
| 5,078,301 | A * | 1/1992 | Gladfelter et al. | 222/52 |
| 5,171,523 | A * | 12/1992 | Williams | 422/20 |
| 5,548,859 | A * | 8/1996 | Oberg et al. | 8/150 |
| 6,024,767 | A * | 2/2000 | Telesca et al. | 8/142 |
| 2003/0000451 | A1 * | 1/2003 | Wilcox | 116/207 |
| 2005/0049163 | A1 * | 3/2005 | Akbarian et al. | 510/285 |

FOREIGN PATENT DOCUMENTS

FR 2 807 933 * 10/2001

* cited by examiner

*Primary Examiner* — Frankie L Stinson

(74) *Attorney, Agent, or Firm* — Ulmer and Berne LLP

(57) ABSTRACT

A stain treatment apparatus uses a transparent plastic bag with a recloseable opening into which a stained garment is placed. A stain treatment compound is contained within the bag, such as within an ampoule or pouch that releases upon compression or that releases upon exposure to water added to the bag. A thermochromatic indicator assists in filling with water of an appropriate temperature. A completion indicator further assists in indicating completion of the stain treatment regimen. A plurality of stain-specific treatment assemblies may be included that are optimized for a category of stains (e.g., protein, tannin, oil, dye/ink).

18 Claims, 2 Drawing Sheets

GARMENT STAIN TREATMENT BAG

PRIORITY INFORMATION

This application claims priority to U.S. Provisional Patent Application No. 60/916,089 filed May 4, 2007, entitled "Garment Stain Treatment Bag," the disclosure of which is incorporated by reference herein.

BACKGROUND

Embodiments of the present invention relate, in general, to a device for pre-treating a stain on fabric, and more particularly, to a portable enclosure for treating and transporting a garment.

Clothes can be easily stained from food, drink, oils or the like. In the past, soiled clothes may have been permanently stained unless they were immediately washed. There are now a number of commercial detergents and stain-removing formulas capable of removing stains from soiled clothes. However, it may not always be practical to immediately wash clothes. When traveling away from home, it can be even more impractical to immediately wash soiled clothes. In addition, if soiled clothes are not immediately washed, garments which come into contact with the soiled clothes may also be permanently stained.

Even with access to a sink and/or a washing machine, removing a stain from a soiled garment may be an unsanitary and unpleasant activity. For example, it may be preferred not to expose a kitchen sink to certain kinds of biological stains that may be on garments. As another example, the cleansers may irritate the skin, especially when kitchen gloves are not readily available.

While several devices and apparatuses have been made and used for pre-treating a stain on fabric, it is believed that no one prior to the inventors has made or used the invention described in the appended claims.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION

Figure 1:
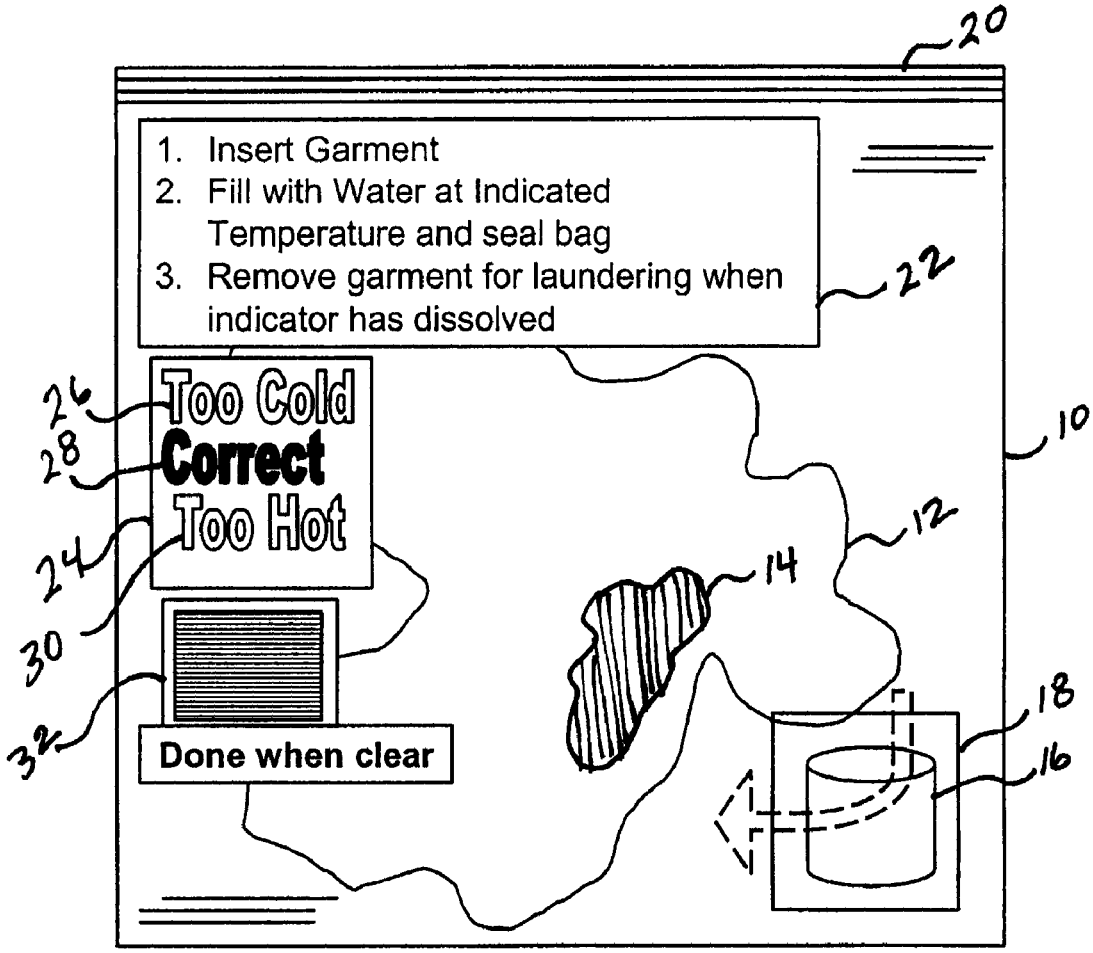
FIG. 1 is a front view of an exemplary embodiment of a stain treatment bag with graphical indicators prompting optimum treatment parameters.

Turning to the Figures, wherein like numerals denote like components throughout the several views, in FIG. 1, a stain treatment receptacle, depicted as a resealable bag 10, provides a barrier for enclosing a garment 12 bearing a stain 14. The garment may be an item of clothing, bedding, or any other item in need of stain treatment. The bag 10 may include an inner cavity sized to receive the garment 12. The size of the bag 10 and the inner cavity may vary based on the garment 12 intended to be treated. The bag 10 is configured to prevent transfer of the stain 14 to other garments and to contain a pre-treatment cleanser 16. The cleanser 16 may include or comprise chemicals that prevent setting of the stain 14 into the fabric, such as detergents or surfactants that assist a detergent or water in removing a stain, any other suitable compounds or materials, and combinations thereof. The pre-treatment cleanser 16 may be placed in the bag 10; however, in the illustrated version a barrier 18 affixes the pre-treatment cleanser 16 to an interior surface of the bag 10. The barrier 18 may be configured to release the pre-treatment cleanser 16 in response to a stimulus provided by the user, including but not limited to introducing water into the bag 10, compressing the barrier 18, or rupturing the barrier 18. The barrier 18 may be porous for instances in which the pre-treatment cleanser 16 is initially in a solid form until dissolved by water passing through the barrier 18. Alternatively, the barrier 18 may be initially impermeable, but be either frangible and subject to rupture under user compression or dissolved upon introduction of water to the bag 10.

The bag 10 includes a resealable opening 20, such as those commonly used in bags referred to as ZIPLOC™ bags (made and manufactured by S.C. Johnson & Son, Inc.), although any suitable type of closure may be used, including, but not limited to an adhesively held flap, a snap, a button, a zipper, or combinations thereof. Printed instructions 22 on the bag 10 may be included, such as the depicted:

1. Insert Garment;
2. Fill with water at indicated temperature and seal bag;
3. Remove garment for laundering when indicator has dissolved.

Of course, other phrasing, terminology or appropriate instructions, including but not limited to the amount of water, may be used instead of or in addition to the instructions depicted in FIG. 1. In addition, the steps may be performed in any suitable order. By way of example only, the user may fill the bag 10 with water prior to inserting the garment 12. The instructions may also include the additional step of releasing the pre-treatment cleanser 16, which may occur before or after the garment 12 has been inserted and before or after the bag 10 has been filled with water. Thereby, contact of the garment 12 with other garments is prevented, which may avoid transfer of the stain and exposure of skin to the stain 14 and the water. In addition, this embodiment may minimize contact with the pre-treatment cleanser 16 or avoid such contact completely.

Advantageously, in the illustrated embodiment, the bag 10 further includes a thermochromatic label 24 depicted as having three temperature indicators, TOO COLD 26, CORRECT 28, and TOO HOT 30. The temperature indicators 26, 28, 30 may be configured to respond to a particular temperature range corresponding to the optimum temperature for the pre-treatment cleanser 16. Of course, the thermochromatic label 24 may include any suitable number of temperature indicators. The thermochromatic label 24 may be configured to respond to the temperature of the water in the bag 10.

In this version, the bag 10 further includes a completion indicator 32 configured to respond to the presence of the pre-treatment cleanser 16 to indicate when sufficient exposure time has elapsed for effective stain removal. The completion indicator 32 may be a material that is dissolved at a rate comparable to stain material. This approach may compensate for differences in water quality, such as mineral content in the water (i.e. hardness or softness of the water), and temperature that may vary the time required for stain removal. Accordingly, in an alternate embodiment, the bag may comprise a completion indicator without a thermochromatic label 24. The completion indicator may alternatively be a thin-film imprinted circuit with dissimilar metal electrodes that produce sufficient electrical current when exposed to the water and/or the pre-treatment cleanser to initiate a timer to indicate completion. Of course any other suitable material or device, or combinations thereof, may be used for the completion indicator.

Although FIG. 1 depicts one particular arrangement, it will be appreciated that the above described elements, including the pre-treatment cleanser 16 and barrier 18, the printed instructions 22, the thermochromatic label 24, and the completion indicator 32 may be configured and placed in any suitable arrangement in or on one or more inner or outer surfaces of the bag 10.

Figure 2:
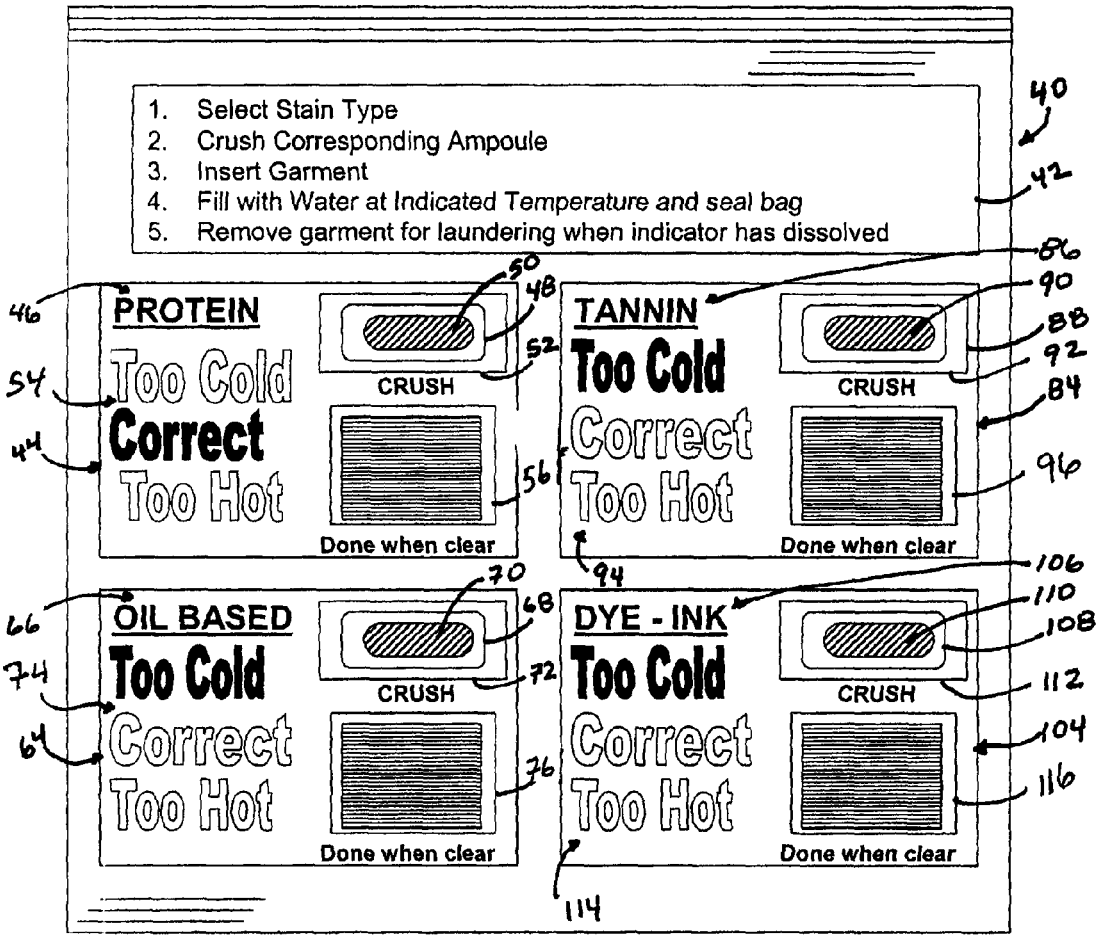
FIG. 2 is a diagrammatic depiction of an alternate exemplary embodiment of a stain treatment bag with treatment regimes selected for the appropriate type of stain.

Turning to FIG. 2, an alternative garment stain treatment receptacle is depicted as a transparent resealable bag 40 that advantageously incorporates multiple selective stain treatment regimens as appropriate for the type of stain. In this embodiment, bag 40 includes printed instructions 42. Printed instructions 42 may be configured to direct the user to the appropriate regimen. As shown in FIG. 2, printed instructions 42 include the following steps:

1. Select Stain Type;
2. Crush Corresponding Ampoule;
3. Insert Garment;
4. Fill with Water at Indicated Temperature and seal bag;
5. Remove garment for laundering when indicator has dissolved.

Of course, other phrasing, terminology or appropriate instructions, including but not limited to the amount of water, may be used instead of or in addition to the instructions depicted in FIG. 2. In addition, the steps may be performed in any suitable order. By way of example only, the user may fill the bag 40 with water prior to inserting the garment or the garment may be inserted prior to crushing the appropriate ampoule.

In the illustrated version, the transparent resealable bag 40 encompasses four stain-specific treatment assemblies. Of course, a bag 40 may comprise any suitable number of stain-specific treatment assemblies. As shown in FIG. 2, first, a protein stain-specific treatment assembly 44 includes a label 46 such as "PROTEIN". Label 46 may include additional or alternative information to assist in identifying this category of stain. In this embodiment, a frangible ampoule 48 containing protein-specific pre-treatment cleanser 50 is adhered to the bag 40. Ampoule 48 may be retained within a permeable barrier 52 configured to capture the ampoule 48 after ampoule 48 is crushed to release cleanser 50. Alternatively, instead of a frangible ampoule, a resilient ampoule or pouch may be directly adhered to the interior surface of the bag 40. The resilient ampoule or pouch may include a weakened or loosely adhered area or opening and be configured to readily release the cleanser 110 under compression. Bag 40 may also include a protein-specific thermochromatic indicator 54 configured to assist in filling bag 40 with water of an optimum temperature for the protein-specific pre-treatment cleanser 50. In the illustrated embodiment, a protein-specific completion indicator 56 is attached to bag 40. The completion indicator 56 may be configured to help the user determine when subsequent laundering is appropriate. Thermochromatic indicator 54 and completion indicator 56 may be configured and operate similarly to thermochromatic indicator 24 and completion indicator 32 described above.

Second, in the embodiment shown in FIG. 2, an oil stain-specific treatment assembly 64 includes a label 66 such as "OIL BASED". Label 66 may include additional or alternative information to assist in identifying this category of stain. As shown, a frangible ampoule 68 containing oil-specific pre-treatment cleanser 70 is adhered to the bag 40. Ampoule 68 may be retained within a permeable barrier 72 configured to capture the ampoule 68 after ampoule 68 is crushed to release cleanser 70. Alternatively, instead of a frangible ampoule, a resilient ampoule or pouch may be directly adhered to the interior surface of the bag 40. The resilient ampoule or pouch may include a weakened or loosely adhered area or opening and be configured to readily release the cleanser 70 under compression. In the illustrated embodiment, bag 40 includes an oil-specific thermochromatic indicator 74 configured to assist a user in filling bag 40 with water of an optimum temperature for the oil-specific pre-treatment cleanser 70. As shown, bag 40 further includes an oil-specific completion indicator 76, which may be configured to help the user determine when subsequent laundering is appropriate. Thermochromatic indicator 74 and completion indicator 76 may be configured and operate similarly to thermochromatic indicator 24 and completion indicator 32 described above.

As shown in FIG. 2, bag 40 includes a tannin stain-specific treatment assembly 84, which comprises a label 86 such as "TANNIN". Label 86 may include additional or alternative information to assist in identifying this category of stain. In this embodiment, a frangible ampoule 88 containing tannin-specific pre-treatment cleanser 90 is adhered to the bag 40, perhaps retained within a permeable barrier 92 to capture ampoule 88 after crushing. Alternatively, instead of a frangible ampoule, a resilient ampoule or pouch may be directly adhered to the interior surface of the bag 40. The resilient ampoule or pouch may include a weakened or loosely adhered area or opening and be configured to readily release the cleanser 90 under compression. Bag 40 may include a tannin-specific thermochromatic indicator 94, as shown in FIG. 2, configured to assist a user in filling bag 40 with water of an optimum temperature for the tannin-specific pre-treatment cleanser 90. In the illustrated embodiment, bag 40 further includes a tannin-specific completion indicator 96, which may be configured to help the user determine when subsequent laundering is appropriate. Thermochromatic indicator 94 and completion indicator 96 may be configured and operate similarly to thermochromatic indicator 24 and completion indicator 32 described above.

The embodiment shown in FIG. 2 includes a fourth stain-specific treatment assembly, namely a dye-ink stain-specific treatment assembly 104, which includes a label 106 such as "DYE-INK". Label 106 may include additional or alternative information to assist in identifying this category of stain. In the illustrated version, a frangible ampoule 108 containing dye-ink-specific pre-treatment cleanser 110 is adhered to the bag 40, perhaps retained within a permeable barrier 112 to capture the ampoule 108 after crushing. Alternatively, instead of a frangible ampoule, a resilient ampoule or pouch may be directly adhered to the interior surface of the bag 40. The resilient ampoule or pouch may include a weakened or loosely adhered area or opening and be configured to readily release the cleanser 110 under compression. In this example, the bag 40 includes a dye-ink-specific thermochromatic indicator 114 configured to assist a user in filling bag 40 with water of an optimum temperature for the tannin-specific pre-treatment cleanser 110. As shown, the bag 40 includes a dye-ink-specific completion indicator 116 which may be configured to help the user determine when subsequent laundering is appropriate. Thermochromatic indicator 114 and completion indicator 116 may be configured and operate similarly to thermochromatic indicator 24 and completion indicator 32 described above.

The embodiment shown in FIG. 2 includes stain-specific treatment assemblies for protein based stains, tannin based stains, oil based stains and dye-ink based stains. Of course, an embodiment may include a stain-specific treatment assembly for any suitable type of stain. Additionally, the one or more stain-specific treatment assemblies may be positioned on the bag in any suitable configuration or arrangement.

While the present invention has been illustrated by description of several embodiments and while the illustrated embodiments have been described in considerable detail, it is not the intention of the applicant to restrict or in any way limit the scope of the appended claims to such detail. Additional advantages and modifications may readily appear to those skilled in the art.

For example, while the illustrated embodiments depict a transparent bag, alternate embodiments consistent with the present invention may employ a translucent or opaque material, or some combination thereof, in order to provide privacy.

For another example, rather than having one bag containing a plurality of stain-specific treatment regimens, applications consistent with aspects of the invention may employ stain-specific bags, perhaps sold in an assortment, to reduce the cost of each bag or for users who tend to encounter the same type of stains repeatedly (e.g., a work environment liable to encounter oil stains).

As an additional example, it should be appreciated that some applications consistent with the present invention may require no addition of water to the bag in order to prevent a stain setting into the garment. For instance, a sufficient liquid quantity of the pre-treatment cleanser may be released to treat the stain.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A stain treatment apparatus comprising:

a liquid impermeable receptacle sized to receive a garment and comprising a closure;

a stain treatment compound, wherein the liquid impermeable receptacle retains the stain treatment compound;

a thermochromatic label responsive to a temperature within the receptacle to indicate an optimum temperature range for use of the stain treatment compound; and an electronic timer that is initiated in response to contact with a fluid.

2. The apparatus of claim 1, further comprising a container affixed to an interior surface of the receptacle, wherein the stain treatment compound is retained within the container.

3. The apparatus of claim 2, wherein the container comprises a first container containing a first stain-specific treatment compound, the apparatus further comprising a second container, wherein the second container contains a second stain-specific treatment compound, and a compound label, wherein the compound label is configured to visually distinguish the first and second containers to facilitate user selection of an appropriate stain treatment regimen for the garment.

4. The apparatus of claim 2, wherein the container comprises a resilient ampoule having a weakened area.

5. The apparatus of claim 2, wherein the container comprises a resilient pouch with a weakened opening.

6. The apparatus of claim 2, wherein the container comprises a frangible ampoule contained within a liquid permeable barrier, wherein the liquid permeable barrier is affixed to an interior of the receptacle.

7. The apparatus of claim 2, wherein the container comprises an impermeable barrier, wherein the impermeable barrier is configured to dissolve upon contact with water thereby releasing the stain treatment compound into the receptacle.

8. The apparatus of claim 2, wherein the stain treatment compound is initially in a solid form, wherein the container comprises a porous barrier configured to allow water to contact the stain treatment compound thereby transitioning the stain treatment compound from a solid form to a liquid form, wherein the stain treatment compound is released through the porous barrier into the receptacle upon transitioning to a liquid form.

9. The apparatus of claim 1, wherein the electronic timer comprises a thin-film imprinted circuit having dissimilar metal electrodes, wherein the electrodes are configured to produce electrical current when exposed to a fluid.

10. The apparatus of claim 1, wherein the receptacle further comprises a plurality of stain treatment compounds and a plurality of containers affixed to an inner surface of the receptacle, wherein the number of stain treatment compounds corresponds to the number of containers, wherein one stain treatment compound is contained within one container, wherein each stain treatment compound is effective with regard to a specific type of stain.

11. The apparatus of claim 1 further comprising an instruction label, wherein the instruction label provides directions to a user regarding use of the apparatus.

12. A stain treatment apparatus comprising:

a resealable liquid impermeable receptacle, the receptacle comprising a closure and an inner cavity, the inner cavity configured to receive a garment;

a first stain-specific treatment assembly configured to treat a first stain and comprising:

a first label visible to the user and configured to identify the first stain;

a first stain treatment compound capable of treating the first stain;

a first container affixed to an interior surface of the inner cavity, the first stain treatment compound being retained within the first container and being selectively releasable in response to a stimulus; and a second stain-specific treatment assembly configured to treat a second stain and comprising:

a second label visible to the user and configured to identify the second stain;

a second stain treatment compound capable of treating the second stain; and a second container affixed to the interior surface of the inner cavity, the second stain treatment compound being retained within the second container and being selectively releasable in response to a stimulus; and an electronic timer that is initiated in response to the stimulus.

13. The stain treatment apparatus of claim 12 further comprising a thermochromatic label responsive to a temperature within the inner cavity to indicate an optimum temperature range for treating at least one of the first and second stains.

14. The stain treatment apparatus of claim 12, wherein the first and second containers comprise respective first and second resilient ampoules having a weakened area.

15. The stain treatment apparatus of claim 12, wherein the first and second containers comprise respective first and second resilient pouches having a weakened opening.

16. The stain treatment apparatus of claim 12, wherein the first and second containers comprise respective first and second frangible ampoules contained within respective liquid permeable barriers, wherein the liquid permeable barrier of each of the first and second frangible ampoules is affixed to the inner cavity.

17. The stain treatment apparatus of claim 12, wherein the first and second containers comprise respective first and second impermeable barriers that are configured to dissolve upon contact with water to release respective first and second stain treatment compounds.

18. The stain treatment apparatus of claim 12, wherein the electronic timer comprises a thin-film imprinted circuit having dissimilar metal electrodes, wherein the electrodes are configured to produce electrical current when exposed to a fluid.

* * * * *